United States Patent [19]

Kato et al.

[11] Patent Number: 4,462,885

[45] Date of Patent: Jul. 31, 1984

[54] CONDUCTOR ARRANGEMENT OF ELECTROLYTIC CELLS FOR PRODUCING ALUMINUM

[75] Inventors: Shozo Kato; Yasuhiko Ujimoto, both of Nagoya, Japan

[73] Assignee: Sumitomo Aluminium Smelting Company, Limited, Osaka, Japan

[21] Appl. No.: 465,923

[22] Filed: Feb. 14, 1983

[30] Foreign Application Priority Data

Feb. 19, 1982 [JP] Japan ..... 57-26690

[51] Int. Cl.[3] ..... C25C 3/16

[52] U.S. Cl. ..... 204/243 M; 204/67; 204/244; 204/DIG. 7

[58] Field of Search ..... 204/67, 243 R, 243 M, 204/DIG. 7, 244, 245, 246, 247

[56] References Cited

U.S. PATENT DOCUMENTS

| | | | |
|---|---|---|---|
| 3,385,778 | 5/1968 | Johnson | 204/243 R |
| 3,415,724 | 12/1968 | Heaton et al. | 204/67 |
| 3,617,454 | 11/1971 | Johnson | 204/67 |
| 3,969,213 | 7/1976 | Yamamoto et al. | 204/244 |
| 4,169,034 | 9/1979 | Morel et al. | 204/243 M |
| 4,270,993 | 6/1981 | Arita | 204/67 |
| 4,396,483 | 8/1983 | Schmidt-Hatting | 204/243 M |

FOREIGN PATENT DOCUMENTS

| | | | |
|---|---|---|---|
| 5216843 | 6/1975 | Japan . | |
| 55-6486 | 5/1979 | Japan . | |
| 5710190 | 6/1979 | Japan . | |
| 57-3751 | 1/1982 | Japan . | |
| WO80/01698 | 8/1980 | PCT Int'l Appl. | 204/243 M |

*Primary Examiner*—Howard S. Williams
*Assistant Examiner*—T. L. Williams
*Attorney, Agent, or Firm*—Stevens, Davis, Miller & Mosher

[57] ABSTRACT

A plurality of rectangular electrolytic cells are disposed in at least two rows of a side-by-side arrangement of cells. A first set of cathode bus bars extends along the outside of the short end of the cell facing the other row of cells. This set of bus bars, along with a second set of bus bars disposed beneath the cell, collect cathode current from the upstream long side of the cell. The second bus bars are positioned, and current through each set of bus bars is controlled, to minimize disruption of the molten bath due to circulation flow.

4 Claims, 3 Drawing Figures

CONDUCTOR ARRANGEMENT OF ELECTROLYTIC CELLS FOR PRODUCING ALUMINUM

This invention relates to an electrolytic cell for producing aluminum and particularly to a conductor arrangement of cathodes in the electrolytic cells, and more particularly to an improvement in conductor arrangement of cathodes in electrolytic cells as disposed in the so-called side-by-side arrangement. The electrolytic cell for producing aluminum will be hereinafter referred to merely "electrolytic cell".

The electrolytic cell is a structure in crucible form with steel frames, whose insides are lined with refractory bricks, and further thereon with calcined carbon blocks and a carbonaceous stamping mass. An electrolyte bath containing cryolite as the main component is contained in the electrolytic cell and kept in a molten state by electric heat generation. Steel cathode current collector bars are embedded in the carbon lining at the bottom of the electrolytic cell and the carbon lining itself serves as a cathode.

Carbonaceous anodes are suspended over the cathode and the bottom end of the anode is dipped in the electrolyte bath. Electrolysis is carried out by passing direct current from the anode to the cathode through the electrolyte bath, and aluminum deposits in a molten state on the cathode surface from the alumina in the electrolyte bath. At the same time, the necessary amount of heat is generated for melting the electrolyte bath.

It is a recent general tendency to utilize electrolytic cells of larger capacity, and such tendency becomes more and more pronounced owing to intensified energy saving and use of automation. On the other hand, with the increasing capacity of the electrolytic cell, a vigorous circulation flow phenomenon happens to appear in the molten aluminum layer due to electromagnetic forces, with the result that the molten aluminum layer is raised up or waves are generated at the boundary surface between the molten aluminum and the electrolyte bath. Consequently, the current efficiency of the electrolytic cell is lowered considerably, or the lining of the electrolytic cell is deteriorated, causing various adverse effects such as early cut-out of the pot.

To reduce such an influence of electromagnetic forces, various conductor arrangements have been proposed for electrolytic cell disposed in the so-called end-to-end and also in the so-called side-by-side. The electromagnetic force is an interaction between an electric current and a magnetic field, and particularly magnetic fields generated by the electric current flowing through the cathode bus bars have a considerable influence. Thus, the adverse effects of the electromagnetic forces seem to be prevented by appropriate arrangement of cathode bus bars.

The electrolytic cells disposed in the end-to-end arrangement are not the specific goal of the present invention, and thus will not be described herein. The electromagnetic forces generated in the electrolytic cells disposed in the side-by-side arrangement will be specifically described below.

The side-by-side arrangement of electrolytic cells means that long sides of the individual electrolytic cells are disposed perpendicular to the current flow direction in a row of electrolytic cells where the ends of the cathode current collector bars are projected from two sides of each electrolytic cell, that is, from upstream side and downstream side of each electrolytic cell with respect to the current flow direction. The former is called upstream side, and the latter downstream side. The electrolytic cells are connected to one another in series, and the upstream side and downstream side of cathode current collector bars of each electrolytic cell on the upstream side are connected to anode bus bars of another electrolytic cell disposed on the downstream side of the former electrolytic cell through the cathode bus bars and rising bus bars.

Electromagnetic forces acting upon the molten aluminum in an electrolytic cell are given by the following equations:

$$FxM = -DzM \cdot By + DyM \cdot Bz \quad (1)$$

$$FyM = DzM \cdot Bx - DxM \cdot Bz \quad (2)$$

$$FzM = DxM \cdot By - DyM \cdot Bx \quad (3)$$

wherein

FxM: electromagnetic force through molten aluminum in the long side direction of the electrolytic cell (as will be hereinafter referred to as "direction x")

FyM: electromagnetic force through molten aluminum in the short end direction of the electrolytic cell (as will be hereinafter referred to as "direction y")

FzM: electromagnetic force through molten aluminum in the vertical direction of the electrolytic cell (as will be hereinafter referred to as "direction z").

DxM: current density through molten aluminum in direction x.

DyM: current density through molten aluminum in direction y.

DzM: current density through molten aluminum in direction z.

Bx : magnetic flux density in direction x.

By : magnetic flux density in direction y.

Bz : magnetic flux density in direction z.

The individual variables can have signs. In the case of direction x, the direction to the right with respect to current flow direction in a row of electrolytic cells has a positive sign; in the case of direction y, the current flow direction has a positive sign; and in the case of direction z, the upward direction has a positive sign.

With respect to the electromagnetic forces in directions x and y as the main causes for generating circulation flow in molten aluminum, the forces in the first terms in the equations (1) and (2) are substantially symmetrical with respect to the axis of direction y passing through the center of each electrolytic cell (the axis will be hereinafter referred to as axis y) and to the axis of direction x passing through the center of each electrolytic cell (the axis will be hereinafter referred to as axis x), respectively, forming electromagnetic forces directed to the center of the electrolytic cell. This is because the main electric current for producing magnetic flux densities (Bx and By) in directions x and y is the current passing through the electrolyte bath and molten aluminum from the anode to the cathode, and unless they are very unbalanced, the composite magnetic fields in directions x and y provide a rotating magnetic field, and the electromagnetic force as a vector product of the rotating magnetic field and the current density in direction z (DzM) is directed to the center of the electrolytic cell.

The second terms in the equations (1) and (2) are vector products of magnetic flux density in direction z (Bz) and current density through the molten aluminum in horizontal directions (DxM and DyM), wherein DxM and DyM are usually symmetrical, since an electrolytic cell takes a rectangular shape on the horizontal level, and is symmetrical with respect to both directions x and y. However, it is hardest to obtain symmetry of Bz, because the main electric current producing Bz flows through the cathode bus bars, and Bz depends upon the arrangement of cathode bus bars.

In the electrolytic cells disposed in the ordinary side-by-side arrangement, the largest magnetic flux density Bz in direction z is found at both corners on the upstream side of the electrolytic cell, and the direction of magnetic flux density is downward at the left corner on the upstream side and upward at the right corner on the upstream side of each electrolytic cell with respect to the current flow direction. That is, distribution of the vertical magnetic flux density Bz is substantially symmetrical with respect to axis y, but considerably asymmetrical with respect to axis x. As a result, the electromagnetic forces FxM and FyM according to the equations (1) and (2) are asymmetrical, which causes an increase in the circulation flow of molten aluminum.

Thus, by making the electromagnetic forces FxM and FyM according to the equations (1) and (2) symmetrical with respect to axis x and axis y, and by making these absolute values smaller, the molten aluminum flow can be decreased and furthermore the heave of molten aluminum can be reduced. In other words, the distribution of vertical magnetic flux density Bz must be symmetrical with respect to axis x and axis y and its absolute value must be made smaller.

On the other hand, electromagnetic forces are generated also in the electrolyte bath (molten salt comprising cryolite as the main component as mentioned before), which forms a layer laid on the molten aluminum in an electrolytic cell.

The electromagnetic forces are given by the following equations:

$$FxB = -DzB \cdot By + DyB \cdot Bz \quad (4)$$

$$FyB = DzB \cdot Bx - DxB \cdot Bz \quad (5)$$

$$FzB = DxB \cdot By - DyB \cdot Bx \quad (6)$$

wherein

FxB: electromagnetic force through the electrolyte bath in direction x.

FyB: electromagnetic force through the electrolyte bath in direction y.

FzB: electromagnetic force through the electrolyte bath in direction z.

DxB: current density through the electrolyte bath in direction x.

DyB: current density through the electrolyte bath in direction y.

DzB: current density through the electrolyte bath in direction z.

Bx : magnetic flux density in direction x.

By : magnetic flux density in direction y.

Bz : magnetic flux density in direction z.

In the foregoing equations, it can be generally regarded that DxB=O and DyB=O, because, since the electric resistance of each electrolyte bath is considerably larger than that of molten aluminum, the electric current passing through the electrolyte bath can be regarded only as a component flowing vertically from the anode to the cathode. Thus, only the component in direction z, i.e. DzB, must be taken into account as the current density present in the electrolyte bath, and the equations (4), (5) and (6) can be rewritten as follows:

$$FxB = DzB \cdot By \quad (7)$$

$$FyB = DzB \cdot Bx \quad (8)$$

$$FzB = O \quad (9)$$

The electromagnetic forces according to the equations (7) and (8), i.e. FxB and FyB also cause a flow in the electrolyte bath.

When the flow of molten aluminum caused by the electromagnetic forces according to equations (1) and (2) is compared with that of electrolyte bath caused by the electromagnetic forces according to the equations (7) and (8), the former flow is a little bigger in the electrolytic cells disposed in the ordinary side-by-side, but when the difference in flow velocities is too large, the boundary surface between the molten aluminum and the electrolyte bath becomes unstable, so that waves are easily generated at the surface boundary. Once the waves are generated, the distance between the anode and the molten aluminum becomes unstable, lowering the current efficiency greatly. Thus, an appropriate conductor arrangement for reducing the difference between the flow of molten aluminum and that of the electrolyte bath is required for more stable electrolytic cell operation.

Various attempts have been so far proposed to reduce the vertical magnetic field acting mainly upon the molten aluninum layer and also to make its distribution symmetrical to reduce the flow of molten aluminum in the conductor arrangement of electrolytic cells disposed in the side-by-side. For example, Japanese Patent Publication No. 16843/77 discloses a conductor arrangement of extending all the cathode bus bars on the upstream side of each electrolytic cell into the space below the cell in parallel to direction y, while turning them to left and right to be in parallel to direction x around the center of the electrolytic cell, and extending them to the outside of the electrolytic cell. According to this arrangement the vertical magnetic field acting upon the molten aluminum layer can be considerably reduced, and the flow of molten aluminum can be thus smaller. However the electromagnetic forces according to the equations (7) and (8) become larger, and consequently the difference between the flow of electrolyte bath and that of molten aluminum is not taken into consideration at all. In fact, according to the present inventors' calculation, it has been found that the difference between the flow of molten aluminum and that of electrolyte bath is rather large.

Japanese Patent Application Kokai (Laid-open) No. 290/81 discloses a conductor arrangement of extending cathode bus bars on the upstream side partly along the outsides on the short ends of each electrolytic cell and partly into the space below the electrolytic cell in parallel to direction y, while turning them to left and right in the space below the electrolytic cell on the downstream side thereof, and extending them to the outsides on the short ends of the electrolytic cell. In this arrangement, the electromagnetic forces through the electrolyte bath are not taken into consideration at all, either, and the difference between the flow of molten aluminum and that of electrolyte bath is rather large.

The present inventors have made extensive studies of a conductor arrangement which can satisfy the following two requirements:

(1) The electromagnetic forces through the molten aluminum i.e. FxM and FyM, according to the equations (1) and (2) are made as symmetrical as possible, and their absolute values are made smaller chiefly to reduce the flow or heave of molten aluminum.

(2) The difference is made as small as possible between the flow of electrolyte bath caused by the electromagnetic forces FxB and FyB through the electrolyte bath according to the equations (7) and (8) and the flow of molten aluminum caused by the electromagnetic forces FxM and FyM through the molten aluminum according to the equations (1) and (2) to reduce the generation of waves at the boundary surface between the molten aluminum and the electrolyte bath.

As a result of the studies of various conductor arrangements according to computer programs, the present inventors have found that the requirement (2) is not always satisfied by reducing the flow of molten aluminum only in the requirement (1), and as a result of further studies, the present inventors have found a conductor arrangement which can substantially satisfy the requirements (1) and (2).

The present invention provides electrolytic cells where most or all (60% or more) of the cathode electric current collected at the upstream side of each electrolytic cell in a first row is passed through cathodic bus bars disposed in the spaces below the electrolytic cell in parallel to the axial line of the row of electrolytic cells and a portion of the cathode electric current at the upstream side is passed through the cathode bus bars extending along the outside on the short end of each electrolytic cell toward the adjacent row direction in the first row in accordance with the degree of an influence of the electrolytic cells in the adjacent row. When the degree of the influence of the electrolytic cells in the adjacent row is very small, it is possible to omit the cathode bus bars extending along the outsides on short ends of the electrolytic cells toward the adjacent row direction in the first row. The cathode bus bars disposed in the space below each electrolytic cell in parallel to the axial line of the row of electrolytic cells are turned to left and right at a specific position on the downstream side in the space below the electrolytic cell and then extended to the outside on the short end of the electrolytic cell, whereby electrolytic cells that can substantially satisfy the said requirements (1) and (2) can be provided.

The present invention will be described in detail below, referring to the attached drawings.

FIG. 1 schematically shows an arrangement of electrolytic cells in two rows in an electrolytic plant.

Figure 1:
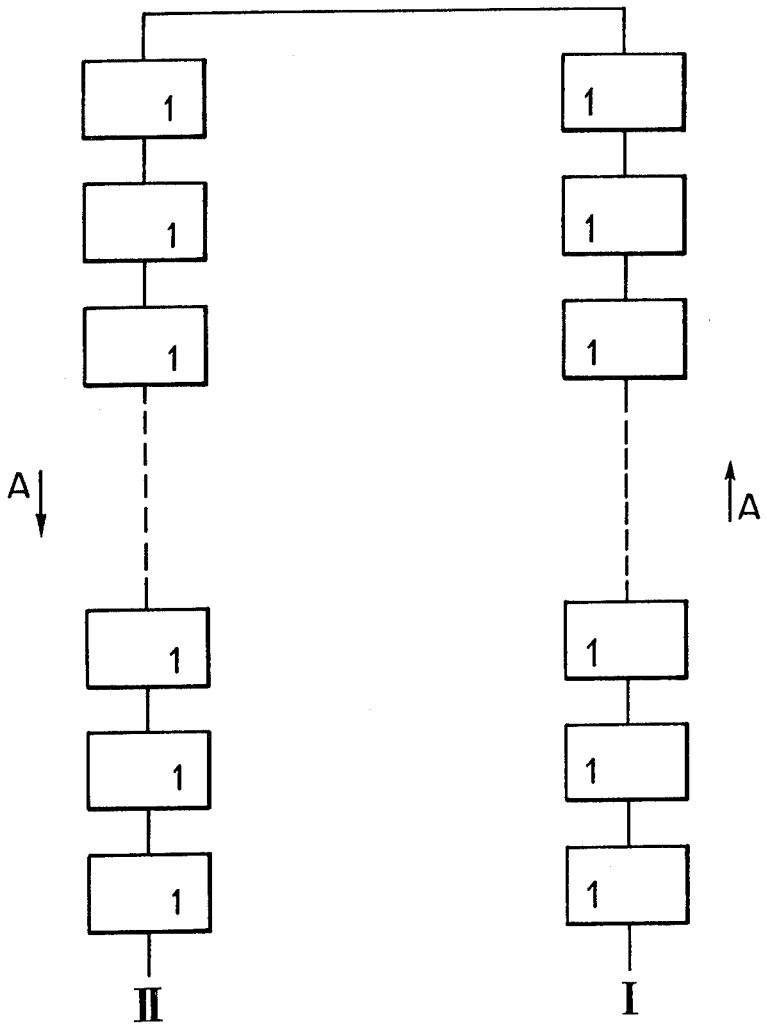

In the ordinary electrolytic plant, a row of electrolytic cells are provided together with an adjacent row of electrolytic cells for the electrical reasons. That is, as shown in FIG. 1, the electric current passes through electrolytic cells 1, 1, . . . arranged in row I at first and then through electrolytic cells 1,1, . . . arranged in row II, where the overall direction of electric current is given by arrow A. In FIG. 1, two rows of electrolytic cells are shown, but further rows can be arranged.

The term "adjacent row" herein used means row II from the viewpoint of row I or row I from the viewpoint of row II. The present invention relates to a conductor arrangement of electrolytic cells in at least two rows, i.e. one row and an adjacent row.

Figure 2:
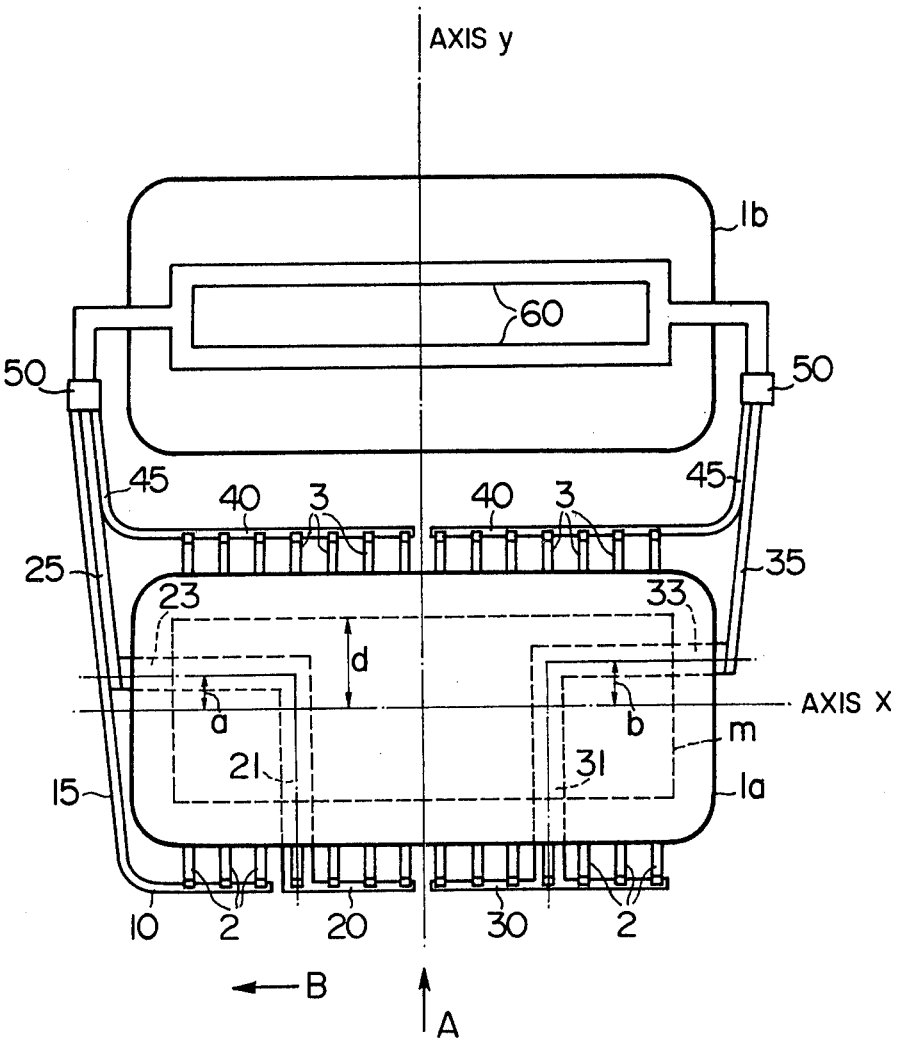
FIG. 2 is a schematic plan view showing a basic conductor arrangement of electrolytic cells according to the present invention.

In FIG. 2, a basic conductor arrangement of electrolytic cells according to the present invention is shown, where numerals 1*a* and 1*b* are electrolytic cells in a given row disposed in the arrangement as in FIG. 1, and whenever it is not particularly necessary to differentiate 1*a* from 1*b*, they will be hereinafter referred to merely as electrolytic cell 1. Arrow A shows the overall direction of electric current, and arrow B shows the direction of the adjacent row location.

With regard to electrolytic cell 1*a* disposed on the upstream side in the row an arrangement mainly of cathode bus bars is shown, whereas with regard to electrolytic cell 1*b* disposed on the downstream side in the row an arrangement mainly of anode bus bars is shown. Dotted line m in electrolytic cell 1*a* disposed on the upstream side in the row shows a molten aluminum zone. Axis x and axis y are center lines in the long side direction and short end direction, respectively, of an electrolytic cell, as described before. In other words, axis y is an axial line of a row of electrolytic cells.

Cathode current collector bars 2, 2, . . . and 3, 3, . . . are projected from the cathode of electrolytic cell 1 toward the upstream side and the downstream side, respectively, and connected to cathode bus bars 10, 20, 30, and 40, as shown in FIG. 2.

In the present invention, 0–40% of cathode current collected at the upstream side (corresponding to one half of total current) is passed through cathode bus bars 10 and 15 extending along the outside on the short end of the electrolytic cell 1 toward second row direction in the first row, whereas the remainder of the cathode current collected at the upstream side, that is, the current collected at cathode bus bars 20 and 30 is passed through at least two cathode bus bars 21 and 31 disposed in the space below the electrolytic cell 1 in parallel to the axial line (axis y) of the row of electrolytic cells. The cathode bus bars 21 and 31 can be divided into pluralities of small bus bars, respectively.

If the total electrolytic current is designated by I, I/2 current is collected at each of the upstream side and the downstream side. If the ratio of the current passing through the cathode bus bars 10 and 15 to I/2, of the current collected at the upstream side is designated by $\alpha$, it must be that $\alpha=0-0.4$ in the present invention. This ratio $\alpha$ is to cancel the influence of vertical magnetic field from the adjacent row, and must be properly selected in view of the degree of the influence.

Generally, the vertical magnetic field is more intensified with decreasing distance from the adjacent row. Thus $\alpha=0$ is possible only where the adjacent row is located so far that it gives no substantial influence, or when steps are taken for theoretically cancelling the influence of the adjacent row, for example, as disclosed in Japanese Patent Application Kokai (Laid-open) No. 6486/80. In the case of $\alpha=0$, the cathode bus bars 10 and 15 extending along the outsides on short ends of electrolytic cells toward the adjacent row direction will be unnecessitated. When $\alpha$ exceeds 0.4 on the other hand, the symmetry of vertical magnetic field in an electrolytic cell 1 is disturbed, or the difference between the flow of molten aluminum and that of electrolyte bath is increased. Actually it seems hard to completely eliminate the vertical magnetic field from the adjacent row, whatever steps should be taken, and thus it is preferable to pass current, even if in a small amount, to the cathode bus bars 10 and 15. A larger amount of current to the cathode bus bars 10 and 15 has an adverse effect, unless the adjacent row is very near. Thus, the preferable value of $\alpha$ is in a range of 0.05–0.3.

According to an example of calculation made by the present inventors for electrolytic cells with a current capacity of 175 KA, the two requirements can be satisfied by using $\alpha=0.2$–$0.3$ when the distance to the adjacent row (center-to-center distance) is 25 m, and by using $\alpha=0.05$–$0.2$ when the distance is 45 m.

Among the cathode current at the upstream side (I/2), other current than that to the cathode bus bars 10 and 15 extending to the outsides on short ends of electrolytic cells toward the adjacent row direction ($\alpha$I/2) is passed to the cathode bus bars 21 and 31 disposed in the space below the electrolytic cell. Suppose the respective ratios to the cathode current at the upstream side (I/2) are $\beta$ and $\gamma$, $\alpha+\beta+\gamma=1$. Generally, it is made that $\alpha+\beta=\gamma$ or $(\alpha+\beta)/\gamma=1$.

The cathode bus bars 21 and 31 disposed in the space below the electrolytic cell are turned to left and right therein and connected to cathode bus bars 23 and 33, respectively, and extended to the outsides on the short ends of the electrolytic cell. The position of turning is important in the present invention. If the distance from the center line (axis x) in the long side direction of electrolytic cell 1 to the end of molten aluminum zone in the electrolytic cell 1 is d, the distance from the axis x to the cathode bus bar 23 turned toward the adjacent row side be a and the distance from the axis x to the cathode bus bar 23 turned toward the side opposite to the adjacent row is b, the position of turning is on the downstream side from the axis x and is in the following ranges in the present invention:

$$a=0.3\,d\text{–}0.7\,d$$

$$b=0.4\,d\text{–}0.7\,d$$

As a result of calculation in view of various data, that is, economically and physically normally presumable position of conductor, distance to the adjacent row, $\alpha$ value, etc., the present inventors have found that the said requirements (1) and (2) can be substantially satisfied by turning in said ranges.

When the position of turning is nearer to the axis x from the ranges, that is, in the case of $a<0.3d$ and $b<0.4d$, the electromagnetic forces through molten aluminum can be indeed reduced, and thus the flow of molten aluminum is reduced, but the difference from the flow of electrolyte bath is larger to the contrary. That is, the requirement (2) cannot be satisfied.

When the position of turning is nearer to the downstream side than the said ranges, that is, in the case of $a>0.7d$ and $b>0.7d$, the flow of molten aluminum is increased, and also the difference from the flow of electrolyte bath is increased, and thus the said requirements (1) and (2) cannot be satisfied.

The cathode bus bars 23 and 33 turned in the space below the electrolytic cell also can be divided into pluralities of small bus bars, respectively, like the cathode bus bars 21 and 31 disposed in parallel to the axis y in the space below the electrolytic cell, and the values of a and b, when divided, are distances to the electrical center lines of divided bus bars.

The arrangement of cathode bus bars for the cathode current collected at the upstream side of electrolytic cell 1 has been described above. On the other hand, the cathode current collected at the downstream side, that is, the electric current from the electrolytic cell 1 through the cathode current collector bars 3, 3, . . . is passed to the outsides on short ends of electrolytic cell 1 through cathode bus bars 40 disposed in parallel to the long side direction of electrolytic cell 1, like the ordinary electrolytic cell.

The cathode bus bars at the outsides on the short ends of electrolytic cell 1 together both on the upsteam side and the downstream side, are connected to rising bus bars 50 and 50 disposed on the short ends of another electrolyte 1 on the downstream side (electrolytic cell 1*b* in FIG. 2) through cathode bus bars 15, 25, 35, and 45 disposed in parallel to the short end direction of electrolytic cell 1. The rising bus bars 50 and 50 are further connected to an anode bus bar 60 of electrolytic cell 1 to supply the electric current thereto. The rising bus bars 50 and 50 are disposed rather on the upstream side on the short ends of electrolytic cell 1, but can be disposed on the center position of short ends.

Figure 3:
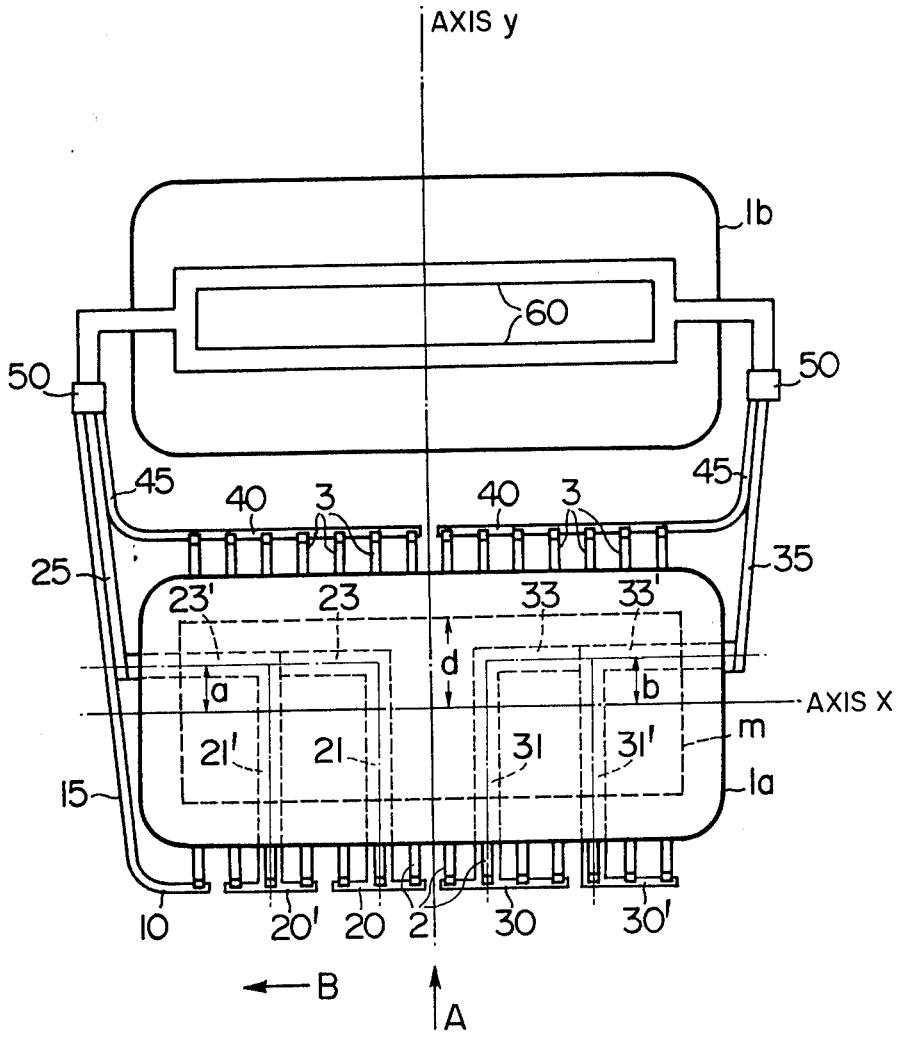
FIG. 3 is a schematic plan view showing one embodiment of the present invention.

In FIG. 3 an actual embodiment of the present invention is shown, where the same members as in FIG. 2 are identified with the same numerals and symbols.

In FIG. 3, cathode current collector bars 2 and 3 are projected from the upstream side and the downstream side of electrolytic cell 1 and connected to cathode bus bars 10, 20, 20', 30 and 30' on the upstream side and cathode bus bars 40 and 40 on the downstream side, respectively. Among the cathode current at the upstream side, the ratio $\alpha$ of current to the cathode bus bars 10 and 15 is set as follows $$\alpha=0.071\ (7.1\%)$$

Also among the cathode current at the upstream side, the ratio $\beta$ of current to the cathode bus bars 21 and 21' disposed in the space below the electrolytic cell on the side toward the adjacent row direction and the ratio $\gamma$ of current to the cathode bus bars 31 and 31' on the side opposite to the adjacent row direction are set as follows:

$$\beta=0.429\ (42.9\%)$$

$$\gamma=0.500\ (50.0\%)$$

The cathode bus bars 21 and 21' and 31 and 31' disposed in parallel to the axis y in the space below the electrolytic cell are turned to left and right, respectively, on the downstream side in the space below the electrolytic cell and connected to the cathode bus bars 23 and 23', and 33 and 33' in parallel to the axis x, respectively, and the distances a and b from the axis x are in the following relationship to the distance d from the center line in the long side direction of the electrolytic cell to the end of the long side of molten aluminum zone in the electrolytic cell 1

$$a=b=0.5d$$

On the other hand, the cathode collector bus bars 3, 3, . . . projected from the downstream side of electrolytic cell 1 are connected in a 50—50 proportion to the cathode bus bars 40 and 40, respectively, disposed in parallel to the long side of electrolytic cell 1 and extended to the outsides on the short ends of electrolytic cell 1. All the cathode bus bars 10, 23, 23', 33, 33', 40 and 40' extended to the outsides on the short ends of electrolytic cell 1 are connected to rising bus bars 50 and 50 of another electrolytic cell 1*b* disposed on the downstream side through the cathode bus bars 15, 25, 35, 45 and 45, respectively.

In this actual embodiment, calculation is based on a preferable arrangement of locating the adjacent row relatively far, particularly by presuming that the distance to the adjacent row (center-to-center distance) is 45 m.

In the conductor arrangement of electrolytic cells according to the present invention, the distribution of electromagnetic forces through the molten aluminum can be made symmetrical, their absolute values can be reduced, and the difference between the flow of molten aluminum and that of electrolyte bath owing to the electromagnetic forces can be reduced, whereby flow or heave of molten aluminum layer can be reduced and generation of waves, which are easy to appear at the boundary surface between the molten aluminum and the electrolyte bath, can be suppressed to the maximum. This can make the capacity of electrolytic cells larger, and can assure stable and efficient cell operation of electrolytic cells with a larger capacity. Thus, the present invention has important commercial significance.

What is claimed is:

1. An apparatus for producing aluminum, comprising a plurality of rectangular, electrolytic cells, disposed in at least two rows of a side-by-side arrangement of cells, each of said cells comprising:

two long sides which are upstream and downstream with respect to current flow along the row in which said cell is located;

two short ends which are substantially parallel to the current flow along the row;

first cathode bus bars for collecting cathode current at the upstream long side of the cell, extending along the outside of the short end of the cell facing the other row;

second cathode bus bars for collecting cathode current at the upstream long side of the cell, disposed in a space below said cell and substantially parallel to the longitudinal direction of the row in which the cell is located, said second bus bars being turned to the left and right in the space below each cell at a position on the downstream side of the longitudinal center line of the cell, at a distance from said center line of 0.3 d to 0.7 d for the turn in the direction toward the other row and 0.4 d to 0.7 d for the turn in the direction opposite to the other row where d is the distance from the longitudinal center line of the cell to a long side of the molten aluminum zone in said cell, the turned second bus bars being extended to the outsides of the short ends of the cell;

third bus bars for collecting cathode current at the downstream long side of the cell, said third bus bars and said bus bars on the outsides of the short ends being connected to rising bus bars disposed on the short ends of a downstream electrolytic cell in the same row; and means for providing that 0–40% of cathode current collected on the upstream long side of the cell is passed through said first bus bars and the remainder of cathode current collected on the upstream long side is passed through said second bus bars.

2. The apparatus of claim 1, wherein said means for providing provides that 5 to 30% of the cathode current collected at the upstream side of each electrolytic cell is passed through said first cathode bus bars.

3. The apparatus of claim 2, wherein said means for providing provides that, the sum of the current in the second cathode bus bars turned toward the other row and the current in the first cathode bus bars extending along the outside of the short end of the electrolytic cell facing the other row is equal to the current in the second cathode bus bars turned opposite to the other row.

4. The apparatus of claim 1, wherein said means for providing provides that the sum of the current in the second cathode bus bars turned toward the other row and the current in the first cathode bus bars extending alone the outside of the short end of the electrolytic cell facing the other row is equal to the current in the second cathode bus bars turned opposite to the other row.

* * * * *